US005141157A

United States Patent [19]

Han et al.

[11] Patent Number: 5,141,157

[45] Date of Patent: Aug. 25, 1992

[54] VANDAL RESISTANT LOCKING DEVICE FOR POP-UP SPRINKLER NOZZLE HOUSINGS

[75] Inventors: Joseph U. Han, Rancho Cucamonga; Hendrik Amirkhanjan, Burbank; Christopher M. Moralez, Chino, all of Calif.

[73] Assignee: Anthony Mfg. Corp., Industrial Div., Azusa, Calif.

[21] Appl. No.: 738,868

[22] Filed: Aug. 1, 1991

[51] Int. Cl.[5] ..... B05B 3/16; B05B 15/10

[52] U.S. Cl. ..... 239/206; 239/203; 239/242; 239/600; 285/29; 411/203; 411/329

[58] Field of Search ..... 285/26, 27, 29, 320; 411/198, 197, 202, 203, 327, 329; 239/203, 204, 205, 206, 600, 237, 240, 242

[56] References Cited

U.S. PATENT DOCUMENTS

| | | | |
|---|---|---|---|
| Re. 25,942 | 12/1965 | Reynolds | 239/237 |
| 3,064,997 | 11/1962 | Karlsson | 285/27 |
| 3,950,014 | 4/1976 | Doubleday | 285/27 |
| 4,200,230 | 4/1980 | Gould | 239/99 |
| 4,212,426 | 7/1980 | Choi | 239/288.5 |
| 4,681,259 | 7/1987 | Troup | 239/228 |
| 4,787,558 | 11/1988 | Sexton et al. | 239/205 |
| 4,840,312 | 6/1989 | Tyler | 239/600 |

*Primary Examiner*—Andres Kashnikow
*Assistant Examiner*—Christopher G. Trainor
*Attorney, Agent, or Firm*—Kelly, Bauersfeld & Lowry

[57] ABSTRACT

A pop-up sprinkler having a nozzle housing threadably coupled to a pop-up stem, and including an axially projecting tab formed on the upper end of the stem which cooperates with spaced ribs formed on the inside of the nozzle housing to prevent over tightening of the nozzle housing relative to the stem during assembly and which resists unthreading of the nozzle housing from the stem to prevent vandals from unthreading the nozzle housing from the stem.

7 Claims, 2 Drawing Sheets

FIG. 1
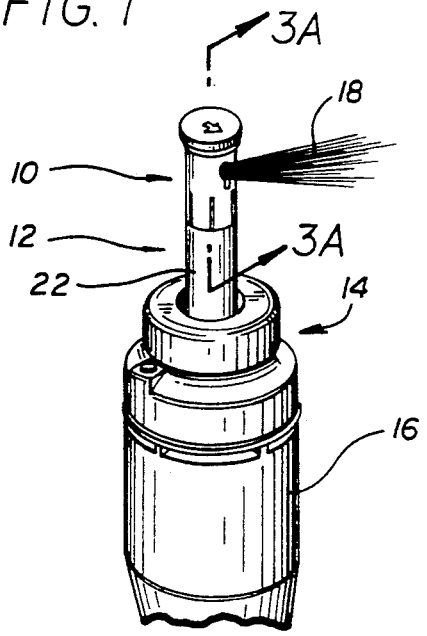
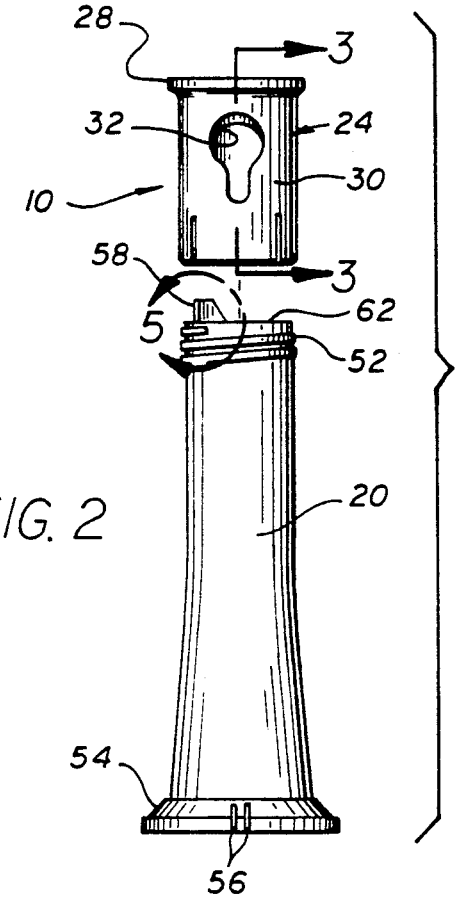
FIG. 2
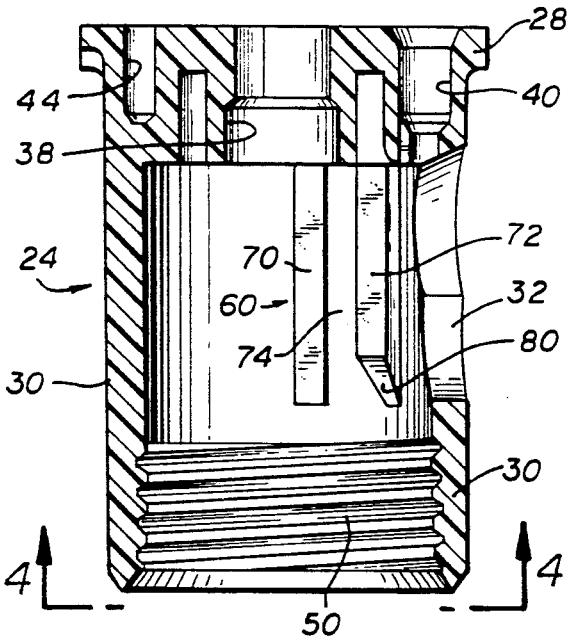
FIG. 3
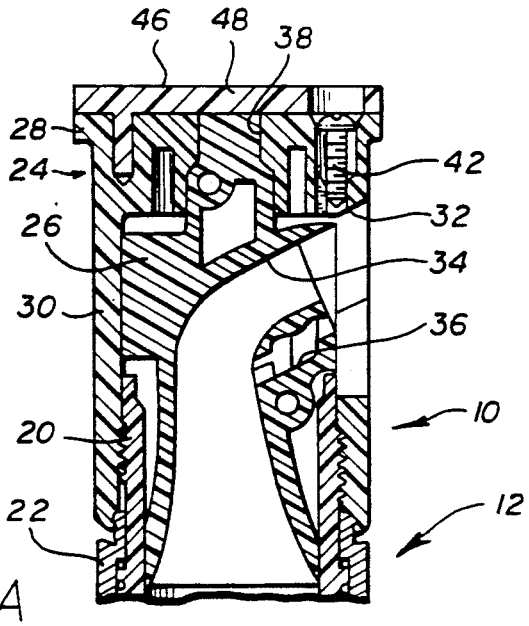
FIG. 3A

FIG. 4
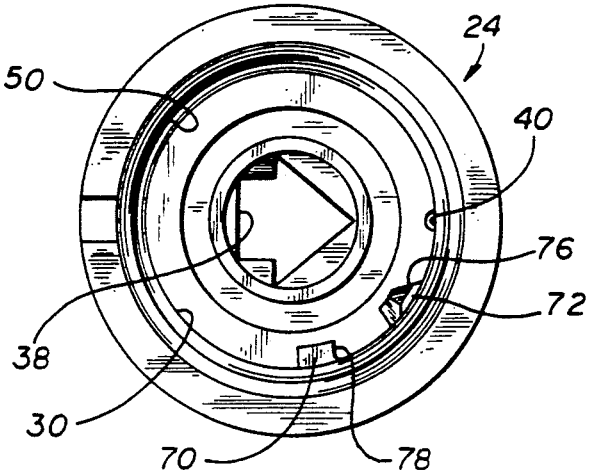
FIG. 5
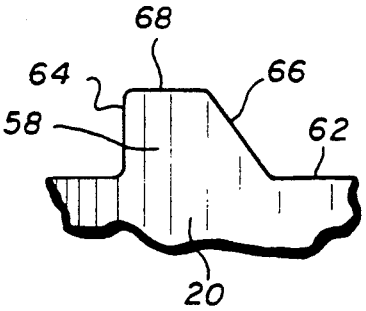
FIG. 6
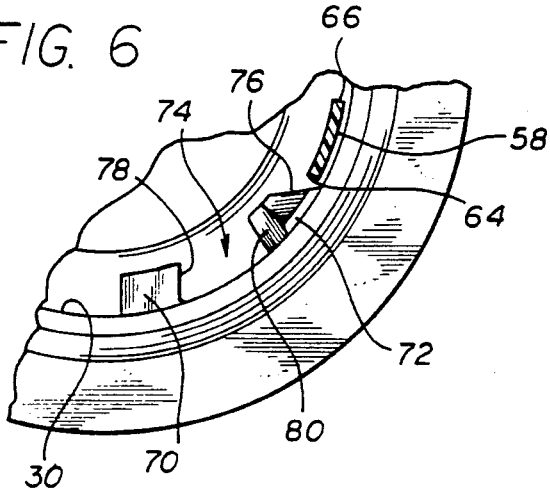
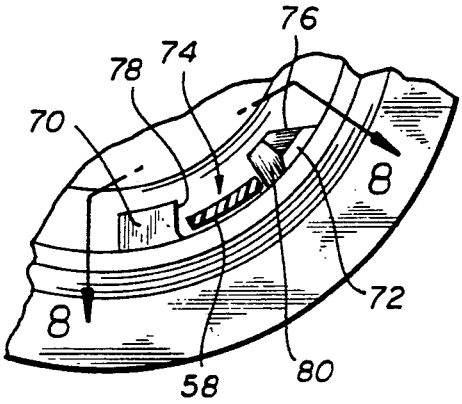
FIG. 7
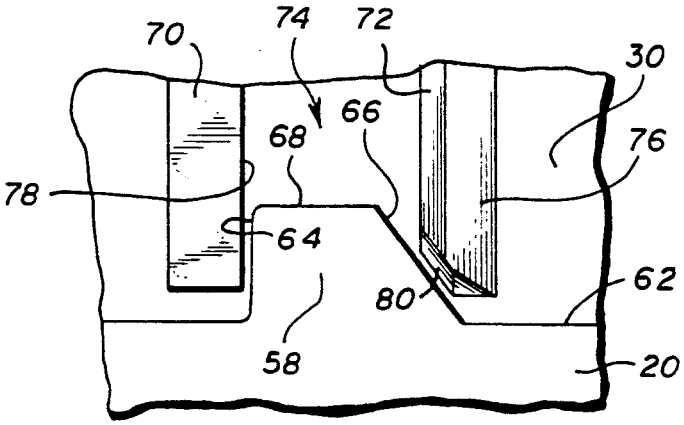
FIG. 8

VANDAL RESISTANT LOCKING DEVICE FOR POP-UP SPRINKLER NOZZLE HOUSINGS

BACKGROUND OF THE INVENTION

This invention relates to irrigation sprinklers, and more particularly to a new and improved vandal resistant and self-aligning locking device for releasably coupling the nozzle housing of a part-circle pop-up sprinkler to the rotary pop-up stem.

In U.S. Pat. No. 4,681,259 issued to Troup et al. Jul. 21, 1987, entitled ROTARY DRIVE SPRINKLER, there is disclosed a pop-up part-circle sprinkler comprising a sprinkler housing within which a rotary drive mechanism is disposed, and including a reversing mechanism including a fixed trip dog and an adjustable trip dog. The rotary drive mechanism operates to rotate a nozzle assembly including a nozzle housing threadably coupled to the upper end of a rotary pop-up stem. Mounted within the nozzle housing is a dual bore nozzle from which water streams are ejected through an aperture in the side wall of the nozzle housing, the water being supplied to the nozzle through the tubular stem from a suitable water supply source coupled to the sprinkler housing.

During assembly of the nozzle housing to the pop-up stem of the sprinkler disclosed in the aforementioned patent, it is important that the nozzle housing be properly aligned relative to the stem to ensure that the discharge outlet from the nozzle is in a predetermined rotational position relative to the fixed trip dog of the reversing mechanism forming part of the sprinkler drive mechanism so that when assembled, the rotary position of the nozzle at one extreme of its rotary motion limits can be fixed and accurately determined from the nozzle housing. Toward this end, as disclosed in the aforementioned patent, timed threads are employed for the connection between the nozzle housing and the upper end of the tubular stem. While the use of timed threads has proved generally satisfactory, it has been found that in some instances, during assembly of the nozzle housing onto the tubular stem, over tightening of the nozzle housing may occur, thereby resulting in the nozzle rotary position being off-set relative to the desired fixed position with respect to the fixed trip dog.

Another problem which has arisen is that the use of a simple threaded connection between the nozzle housing and tubular stem does not prevent vandals from unthreading the nozzle from the stem. Sprinklers of the type disclosed in the aforementioned patent are frequently used in areas subject to vandalism such as public parks, playing fields, and the like, and it is desirable to construct such sprinklers in a manner to deter vandalism.

As will become more apparent hereinafter, the present invention provides a vandal resistant locking device for releasably coupling the nozzle housing to the tubular riser of a rotary pop-up sprinkler such as disclosed in the aforementioned patent, and which eliminates the necessity for timed threads while ensuring that the nozzle housing will always be assembled on the stem with the nozzle outlet in the desired fixed rotary position with respect to the fixed internal trip dog.

SUMMARY OF THE INVENTION

The present invention provides a simple yet effective releasable locking device for coupling the nozzle housing to the pop-up stem of a pop-up rotary sprinkler which is reliable and effective against vandalism while ensuring that proper alignment of the nozzle outlet relative to the fixed trip dog of the sprinkler drive mechanism is always maintained. More specifically, the present invention employs a releasable locking tab formed on the pop-up stem which cooperates with locking projections formed in the nozzle housing to accurately and precisely locate the position of the nozzle outlet relative to the stem, and which locks the nozzle housing and stem together with sufficient rigidity to resist removal of the nozzle housing from the stem by simple hand pressure and without the use of a torque increasing tool.

The various features and advantages of the present invention will become more apparent from the following detailed description taken in conjunction with the accompanying drawings which illustrate, by way of example, the principals of the present invention.

BRIEF DESCRIPTION OF THE DRAWINGS

The accompanying drawings illustrate the invention. In such drawings:

FIG. 1 is a perspective view illustrating a rotary drive sprinkler within which the novel features of the present invention are embodied;

FIG. 2 is an exploited perspective view illustrating a nozzle housing and pop-up stem incorporating the present invention prior to assembly;

FIG. 3 is an enlarged sectional view taken substantially along the line 3—3 of FIG. 2;

FIG. 3A is an enlarged fragmentary sectional view taken substantially along the line 3A—3A of FIG. 1;

FIG. 4 is a bottom plan view as viewed in the direction of line 4—4 of FIG. 3;

FIG. 5 is an enlarged fragmentary perspective view generally corresponding with the area designated by the circle 5 in FIG. 2 and illustrating a locking tab formed on the stem;

FIG. 6 is an enlarged fragmentary bottom plan view, partially in cross section, illustrating the nozzle housing and locking tab during assembly and prior to locking engagement;

FIG. 7 is an enlarged fragmentary plan view, partially in cross section and similar to FIG. 6 illustrating the nozzle housing and stem in the fully coupled condition with the lock tab locked in position; and FIG. 8 is an enlarged fragmentary perspective view as seen in the direction of the line 8—8 of FIG. 7.

DETAILED DESCRIPTION OF THE PRESENTLY PREFERRED EMBODIMENT

As shown in the exemplary drawings, the present invention is embodied in a new and improved vandal resistant and self-aligning locking device for releasably coupling a spray head, generally indicated 10 in FIG. 1, to a rotary pop-up stem assembly, generally indicated 12, of a part-circle rotary pop-up sprinkler, generally designated 14. In this instance, as shown in FIG. 1, the rotary pop-up sprinkler 14 is of the type illustrated and described in U.S. Pat. No. 4,681,259 issued Jul. 21, 1987 entitled ROTARY DRIVE SPRINKLER, the disclosure of which is hereby incorporated by reference into this application. The rotary drive sprinkler 14 herein is preferably made of molded plastic and includes a sprinkler casing 16 which is adapted to be coupled to a suitable water supply source (not shown) and buried in the ground, and which includes within the casing a water driven rotary motor and reversing mechanism (not shown) for rotating the spray head 10 to eject irrigating water laterally of the sprinkler, as schematically illustrated by the spray 18. The spray head 10 is supported by an inner pop-up stem 20 (see FIG. 3A) which herein is generally tubular in shape and rotatably mounted within a retractable outer stem 22 which projects above the housing 16 when the sprinkler 14 is in use, the inner pop-up stem being in turn coupled to the rotary drive motor and reversing mechanism inside the casing 16.

As best seen in FIGS. 2 and 3A, the spray head 10 includes a downwardly open generally cylindrical nozzle housing 24 carrying an internal nozzle assembly 26 and is releasably coupled to the upper end portion of the inner pop-up stem 20. In this instance, the housing 24 includes an upper, generally cylindrical cap portion 28 integrally formed with a downwardly extending cylindrical skirt portion 30, and through which a generally key shaped outlet opening 32 is formed, the nozzle assembly 26 including dual outlet nozzles 34 and 36 aligned with the opening and through which water is ejected. As disclosed in the aforementioned patent, the nozzle assembly 26 preferably is formed as mating molded plastic halves which are held together within the nozzle housing 24. the nozzle housing including an upper key way 38, herein in the shape of an arrow, for receiving the nozzle halves and aligning the nozzle outlets 34 and 36 with the outlet opening 32 of the housing. Formed through the cap portion 28 of the nozzle housing 24 and aligned with the outlet opening 32 is a stream splitter screw opening 40 for receiving an adjustable screw 42 for controlling the distribution of water ejected from the upper nozzle outlet 34. Axially directed recesses 44 are also herein provided in the cap portion 28 of the nozzle housing 24 for receiving the mounting legs 46 of a protective cover 48which can be disposed over the cap portion to protect the spray head 10.

To couple the spray head 10 to the inner pop-up stem 20, disposed about the inner periphery of the lower portion of the nozzle housing skirt portion 30 are internal threads 50 which are formed to mate with corresponding external threads 52 formed about the upper end portion of the inner pop-up stem 20. As can best be seen in FIG. 2, the inner pop-up stem 20 is generally tubular in shape, and includes an enlarged diameter flanged lower end portion 54 provided with guide tabs 56 through which the stem is coupled to the rotary drive motor and reversing mechanism carried within the casing 16, as more fully explained in the aforementioned U.S. Pat. No. 4,681,259.

To assemble the spray head 10 on the inner pop-up stem 20, the nozzle housing 24 with the nozzle assembly 26 fixedly mounted therein, is positioned in alignment with the stem, and the internal threads 50 are threaded onto the external threads 52 of the stem. During this assembly, it is important that the nozzle housing 24 not be overtightened relative to the pop-up stem 20 since the relative rotary position of the fixed trip dog of the reversing mechanism is keyed to the location of the guide tabs 56 on the stem. That is, when assembled, the nozzle housing 24 must always be properly aligned relative to the guide tabs 56 of the inner pop-up stem 20 so that the nozzle outlets 34 and 36 are always in the same rotary position relative to the fixed trip dog of the reversing mechanism.

In accordance with the present invention, a locking and alignment tab 58 is formed on the inner pop-up stem 20 to cooperate with locking and alignment ribs, generally designated 60, formed in the nozzle housing 24 to ensure that the spray head 10 is always properly aligned with the pop-up stem, and which prevents over tightening of the nozzle housing on the pop-up stem. Moreover, the locking and alignment tab 58 functions with the ribs 60 to provide a reliable and effective means for deterring vandals from readily removing the spray head 10 from the sprinkler 14.

Toward these ends, the tab 58 is integrally molded with and projects axially upwardly from the upper end 62 of the plastic inner stem 20 above the threads 52, and herein has a generally trapezoidal shape defining a generally axially directed vertical flat sidewall 64 circumferentially spaced to the left in FIG. 5 from an upwardly inclined sidewall 66 terminating in a generally horizontal top wall 68, the vertical sidewall 64 being formed as the leading sidewall during threading of the nozzle housing 24 on to the inner stem, and the inclined sidewall 66 being formed as the leading sidewall during unthreading.

As best seen in FIGS. 3 and 4, the locking and alignment ribs 60 herein comprise two elongated and circumferentially spaced axially directed projections 70 and 72 integrally molded with and extending radially inwardly from the inner surface of the skirt portion 30 of the nozzle housing 24 above the internal threads 50. The function of the projections 70 and 72 is to receive the locking and alignment tab 58 during assembly of the spray head 10 onto the inner stem 20, and to releasably restrain the nozzle housing 24 from any unthreading from the stem. As shown, the ribs 60 are positioned to be to one side of the outlet opening 32 and are disposed so as not to interfere with the nozzle assembly 26 within the nozzle housing 24. Advantageously, the location of the ribs 60 within the nozzle housing 24 can be initially selected so as not to interfere with the nozzle assembly 26, and then the relative circumferential position of the tab 58 on the inner stem 20 can be selected so as to insure that the cooperation of the tab and ribs will result in the nozzle outlet 32 always having the proper orientation with respect to the stem guide tabs 56.

The space, herein designated 74, between the projections 70 and 72 is preferably approximately equal to the width of the tab 58 so as to permit the tab to be located therebetween. One projection, herein the right or leading projection 72 as viewed in FIGS. 3 and 4, is formed to have an inclined axial face 76 which functions as a cam to deflect the tab 58 over the projection as the nozzle housing 24 is threaded on to the inner housing 20. Herein, the inclined face 76 is formed to have an angle of inclination of approximately forty-five degrees although it is contemplated that other angles are usable, the angle of inclination determining the amount of torque required for threading the nozzle housing 24 onto the inner stem 20. Notably, the height of the tab 58 above the external threads 52 and the location of the projections 70 and 72 above the internal threads 50 are selected such that during assembly of the nozzle housing 24 onto the stem 20, the threads will be substantially fully mated when the tab reaches the space 74 between the projections 60. Once the vertical sidewall 64 of the tab 58 engages the inclined face 76 of the projection 72, continued threading of the nozzle housing 24 onto the inner stem 20 causes the tab to deflect radially inwardly and ride over the projection until it drops into the space 74 between the ribs 60.

The left or trailing projection 70 as viewed in FIGS. 3 and 4 herein has a generally rectangular lateral cross section with a slightly undercut flat face 78 formed on the right or leading edge side of the projection. This undercut flat face 78 acts as a stop for preventing the locking and alignment tab 58 from being moved out of the space 74 over the trailing projection 70, thereby preventing the nozzle housing 24 from being further threaded onto the stem 20 once the tab has entered the space between the projections. That is, the undercut flat face 78 acts as a positive stop for the flat sidewall 64 of the tab 58 to prevent over threading of the spray head 24 relative to the inner stem 20.

Thus, when assembling the spray head 10, once the nozzle housing 24 has been threaded onto the inner stem 20 to a point where the tab 58 has cammed over the inclined face 76 of the leading projection 72 and dropped into the space 74, the vertical sidewall 64 abuts the under cut face 78 of the projection 70 to prevent further threading of the nozzle housing onto the inner stem, thereby insuring that overtightening can not occur, and that the nozzle outlet 32 will always be aligned in the same rotary position relative to the guide tabs 56 of the inner stem. Moreover, once the spray head 10 has been assembled, the locking and alignment tab 58 prevents the nozzle housing 24 from being easily unthreaded and removed from the inner stem 20.

Since it is desirable that the spray head 10 be capable of being disassembled for purposes of servicing the sprinkler 14, yet undesirable to permit easy disassembly, the locking and alignment tab 58 cooperates with the projection 72 to releasably resist unthreading of the nozzle housing 24 without the use of special torque increasing tools such as pliers and wrenches. Toward this end, as best seen in FIG. 8, the lower edge portion of the leading projection 72 is provided with a chamfered rear edge 80 having a slightly inclined surface, preferably on the order of about ten degrees, and which herein is formed to be substantially parallel with the inclined sidewall 66 of the locking and alignment tab 58. By selection of the angle of inclination of the chamfered edge 80, the amount of torque required to deflect the tab 58 over the projection 72 can be controlled, the greater the angle of inclination, the lower the torque required.

With this arrangement, when the nozzle housing 24 is attempted to be rotated in the unthreading direction relative to the inner stem 20, the inclined sidewall 66 of the tab 58 abuts the chamfered edge 80 to resist the unthreading rotation. Preferably, the locking and alignment tab 58 is formed to have sufficient rigidity to resist deflection under normal torque loads which are likely to be encountered when the nozzle housing 24 is turned by hand, but to be sufficiently flexible to permit the tab to deflect radially to an extend sufficient to ride over the projection 72 when torque is applied through use of a torque increasing tool. Thus, while being unthreadable by simple hand rotation, with the use of a torque increasing tool, the tab 58 can be caused to be cammed over the inclined chamfered edge 80 to permit unthreading of the nozzle housing 24 from the inner stem 20.

As schematically illustrated, in FIGS. 6 and 7, when the nozzle housing 24 is threaded onto the inner stem 20, herein by rotating the nozzle housing in the counter clockwise direction as viewed in the fragmentary illustration of FIGS. 6 and 7 which are taken looking upwardly from the lower open end of the skirt portion 30, the tab 58 is deflected by the inclined surface 76 over the leading projection 72. Due to the inherent residency of the tab 58, once the tab has moved over the leading projection 72, the tab will snap into the space 74 between the projections 70 and 72 whereupon the vertical sidewall 64 will abut the undercut flat face 78 of the trailing projection 70. This abutment of the tab 58 against the trailing projection 70 prevents further rotation of the nozzle housing 24 relative to the inner stem 20. Once seated in the space 74, the tab 58 resists unthreading rotation of the nozzle housing 24 relative to the inner stem 20, and a torque increasing tool must be used to force the tab to ride up the chamfered edge 80 and cam over the projection 72.

From the foregoing, it should be apparent that the locking and alignment tab 58 cooperates with the locking and alignment ribs 60 to prevent over tightening of the nozzle housing 24 during assembly of the spray head 10 on the inner riser 20, and releasably restrains the nozzle housing against removal from the stem to provide a vandal resistant coupling of the spray head to the stem. While a particular form of the invention has been illustrated and described, it should be apparent that various modifications and changes can be made with out departing from the spirit and scope of the present invention.

We claim:

1. In a pop-up sprinkler of the type having a spray head threadably coupled to a rotary pop-up stem, said spray head including a generally cylindrical nozzle housing having a cap portion with a downwardly extending cylindrical skirt portion open at its lower end and carrying internal threads adjacent the lower end, the stem having a generally cylindrical upper portion carrying external threads adapted to mate with the internal threads of the nozzle housing, the improvement comprising:

tab means formed on the upper end of said stem and projecting axially therefrom; and circumferentially spaced rib means formed within the skirt portion of the nozzle housing, said rib means cooperating with said tab means to prevent over tightening of said nozzle housing during threading of said nozzle housing onto said stem, and releasably restraining said nozzle housing against unthreading for removal of said nozzle housing from said stem.

2. The improvement as set forth in claim 1 wherein said tab means comprises a flexible plastic tab of predetermined circumferential width, and said rib means comprise a pair of radially inwardly extending projections circumferentially spaced by an amount substantially equal to the width of said tab.

3. The improvement as set forth in claim 2 wherein one of said ribs is a leading rib and the other is a trailing rib in the direction of threading said nozzle housing onto said stem, said leading rib having an inclined surface for camming said tab over said leading rib during threading of said nozzle housing onto said stem.

4. The improvement as set forth in claim 3 wherein said trailing rib has an undercut surface for abutting said tab and preventing said tab from moving over said trailing rib thereby to prevent over tightening of said nozzle housing during threading onto said stem.

5. The improvement as set forth in claim 4 wherein said leading rib has an inclined chamfered edge for releasably restraining said tab from camming over said leading rib when said nozzle housing is rotated relative to said stem in the unthreading direction.

6. The improvement as set forth in claim 5 wherein said tab has a generally trapezoidal shape with a generally vertical leading edge and an inclined trailing edge relative to the direction of threading of said nozzle housing onto said stem.

7. The improvement as set forth in claim 6 wherein said chamfered edge of said leading rib is substantially parallel with said inclined trailing edge of said tab.

* * * * *

UNITED STATES PATENT AND TRADEMARK OFFICE

CERTIFICATE OF CORRECTION

PATENT NO. : 5,141,157

DATED : August 25, 1992

INVENTOR(S) : Joseph U. Han, Hendrik Amirkanian
Christopher M. Moralez

It is certified that error appears in the above-identified patent and that said Letters Patent is hereby corrected as shown below:

Title page, item [75] Inventors: "Amirkhanjan"
should be --Amirkhanian--.

Signed and Sealed this

Twenty-fourth Day of August, 1993

*Attest:*

*Attesting Officer*

BRUCE LEHMAN

*Commissioner of Patents and Trademarks*